US006636179B1

(12) United States Patent
Woo et al.

(10) Patent No.: US 6,636,179 B1
(45) Date of Patent: Oct. 21, 2003

(54) V-TYPE APERTURE COUPLED CIRCULAR POLARIZATION PATCH ANTENNA USING MICROSTRIP LINE

(75) Inventors: Jong-Myung Woo, Department of Radio Sciences and Engineering Chungnam-University, 220 Koong-dong, Youseong-gu, Taejon (KR); Byung-Kook Kim, Taejon (KR)

(73) Assignees: Jong-Myung Woo, Taejon (KR); Newcom Electronics Co., Ltd., Chungcheongnam-do (KR)

( * ) Notice: Subject to any disclaimer, the term of this patent is extended or adjusted under 35 U.S.C. 154(b) by 0 days.

(21) Appl. No.: 09/546,630

(22) Filed: Apr. 10, 2000

(30) Foreign Application Priority Data

Apr. 8, 1999 (KR) ..... 99-12416

(51) Int. Cl.[7] ..... H01Q 1/38

(52) U.S. Cl. ..... 343/700 MS; 343/848; 343/830

(58) Field of Search ..... 343/700 MS, 848, 343/846, 830, 767, 795, 872, 713, 829, 771, 770, 768, 725, 729, 853

(56) References Cited

U.S. PATENT DOCUMENTS

| | | | | | |
|---|---|---|---|---|---|
| 4,242,685 | A | * | 12/1980 | Sanford | 343/700 MS |
| 4,843,400 | A | * | 6/1989 | Tsao et al. | 343/700 MS |
| 4,903,033 | A | * | 2/1990 | Tsao et al. | 343/700 MS |
| 5,001,492 | A | * | 3/1991 | Shapiro et al. | 343/700 MS |
| 5,241,321 | A | * | 8/1993 | Tsao | 343/700 MS |
| 5,406,292 | A | * | 4/1995 | Schnetzer et al. | 343/700 MS |
| 5,633,645 | A | * | 5/1997 | Day | 343/700 MS |
| 5,675,346 | A | * | 10/1997 | Nishikawa et al. | 343/700 MS |
| 5,949,376 | A | * | 9/1999 | McDonald et al. | 343/700 MS |
| 6,018,320 | A | * | 1/2000 | Jidhage et al. | 343/700 MS |

* cited by examiner

*Primary Examiner*—Don Wong
*Assistant Examiner*—Chuc Tran D
(74) *Attorney, Agent, or Firm*—Robert E. Bushnell, Esq.

(57) ABSTRACT

A V type aperture coupled circular polarization patch antenna constructed with a microstrip line formed on a rear face of a dielectric substance, a ground surface formed on an entire face of the dielectric substance, a V type aperture formed at a desired angle on the basis of a portion of the ground surface, which overlaps with the microstrip line, and a patch formed into a rectangular shape and mounted at an upper portion of the aperture so as to cover the aperture. At 1.9375 GHz, which is one of center frequencies of IMT-2000, the reflection loss is −11.34 dB, the band width at minus 10 dB is 15.2% (295 MHz), the beam width is 60°, and a proper circular polarization may be obtained.

30 Claims, 8 Drawing Sheets

(c)

Mi : Level(dB) Ii : frequency(GHz)

Mi : Impedence(Ω) Ii : frequency(GHz)

V-TYPE APERTURE COUPLED CIRCULAR POLARIZATION PATCH ANTENNA USING MICROSTRIP LINE

CLAIM OF PRIORITY

This application makes reference to, incorporates the same herein, and claims all benefits accruing under 35 U.S.C. §119 from my application V-TYPE APERTURE COUPLED CIRCULAR POLARIZATION PATCH ANTENNA USING MICROSTRIP LINE filed with the Korean Industrial Property Office on the $8^{th}$ day of April 1999 and there duly assigned Ser. No. 12416/1999.

BACKGROUND OF THE INVENTION

1. Field of the Invention

The present invention relates to satellite-based vehicle communication with a PCS base station and a satellite broadcasting receiver, and, more particularly, to a communication process and V-type aperture coupled circular polarization patch antenna using a microstrip line.

2. Description of the Related Art

Generally, a precise polarization adjustment is needed in a communication system in order to optimize the system and its operational functioning. There are various kinds of polarizations, including linear polarization, circular polarization and elliptical polarization. The design of polarization should be properly selected and used in conformity with the particular system in which the design is being applied. In a vehicle-mounted satellite communication system for example, it is preferable that polarization, which is independent of the moving direction of the vehicle, is used in order to maximize reception of electric waves from the satellite without fluctuation in the level of reception. Therefore, in satellite-based vehicle communication systems, the circular polarization is used in an effort to maintain a constant level of reception, regardless of the direction of movement of the vehicle.

Circular polarization can be produced only when two linear polarizations, which determine the direction of polarization, have the same amplitude and are orthogonal to each other so as to assure a relative phase difference of 90°. A microstrip patch antenna is adequate to satisfy these circular polarization generating conditions as well being suitable for mounting upon a vehicle. That is, the microstrip patch antenna is so thin as to create negligible air resistance and can be mass-produced by contemporary printing technology. Typically, the current distribution provided by the aperture formed in the circular patch of the antenna will be vectorially distributed at an interval of 90°, so that two frequencies radiated by linear differences in the lengths of the components of the aperture resonate. The impedances created by these differences in length, for example, the differences in length between protrusions from the circumference of the circular patch and an inner diameter of the patch, or alternatively, between protrusions and recesss, provide a phase difference of 90° necessary to create a circular polarization generating conditions. I have found that there are some problems with conventional circular polarization patch antennas however, because the design of these antennas are complex and the manufacturing process is therefore unduly complicated.

SUMMARY OF THE INVENTION

It is therefore an object of the present invention to provide an improved process and aperture antenna.

It is another object to provide an aperture coupled circular polarization patch antenna using a microstrip line.

It is still another object to provide a simple design and easily executed process for manufacturing an aperture antenna.

It is yet another object to provide an aperture coupled circular polarization patch antenna using a microstrip line, in which the microstrip line and a patch are separated by a ground surface so that an active device is mounted on the feeding line to be capable of beam scanning of an array antenna.

It is still yet another object to provide a microstrip patch antenna that is adequate to satisfy these circular polarization generating conditions while being suitable for mounting upon a vehicle.

It is a further object to provide a microstrip patch antenna that is thin enough to create negligible air resistance and may be easily mass-produced by contemporary printing technology.

These and other objects may be achieved in the practice of the present invention, with a V type aperture coupled circular polarization patch antenna constructed with a microstrip line that is formed on a rear face of a dielectric substance, a ground surface that is formed on an entire face of the dielectric substance, a V type aperture that is formed at a desired angle on the basis of a portion of the ground surface, and which overlaps with the microstrip line, and a patch that is formed into a rectangular shape and is mounted at an upper portion of the aperture so as to cover the aperture. Preferably, the V type aperture is formed at an angle of 90°, with each length of the long and short sides of the patch being adjusted to provide a phase difference of 90° according to mutual impedance, and size and length of the aperture being adjusted so as to have a phase difference of 90° according to the mutual impedance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figures 1A, 1B:
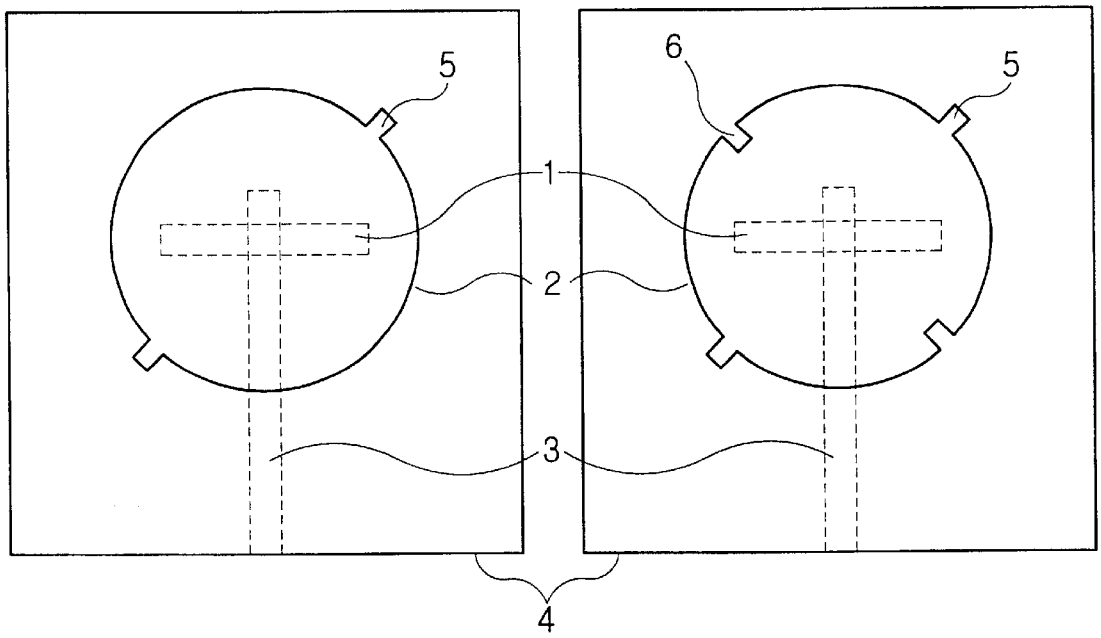
FIGS. 1A and 1B are schematic views showing microstrip circular polarization patch antennas.

Turning now to the drawings and referring to FIGS. 1A and 1B, a conventional circular polarization patch antenna 8*a* or 8*b*, respectively, may be made with a strip, or a microstrip 3, and a circular patch 2. As shown in FIG. 1A, at the circumferential portions of patch 2 which defines angles of 45° with the imaginary centerline of a linear aperture 1 formed on a ground surface 4, there are provided a pair of diametrically opposite protrusions 5 that project radially outwardly to an outer side of circular patch 2, in radial directions. In FIG. 1B, at a portion of patch 2 which defines angles of 45° with respect to the imaginary centerline of linear aperture 1 that is formed on a ground surface 4, a pair of diametrically opposite protrusions 5 are formed to extend radially outwardly from the circumference of patch 2. At diametrically opposite locations on the circumference of circular patch 2 that are at right angles with protrusions 5, there is formed a pair of diametrically opposite recesses 6 which are sunk in radially inward directions into the circumferential side of patch 2. Therefore, patch 2 has a longer diameter between the two diametrically opposite protrusions 5 and a shorter diameter between the two diametrically opposite recesses 6. The current distribution created by aperture 1 is vectorially distributed at an interval of 90° so that two frequencies propagated by the longer and shorter diameters resonate. Moreover, the impedances created by the differences in length in the embodiment illustrated in FIG. 1A between the diameter of protrusion 5 and an inner diameter of the circumference of patch 2, or alternatively, in the embodiment illustrated by FIG. 1B between the diameter of protrusion 5 and the lesser diameter of recess 6, is adapted to provide a phase difference of 90°, thereby satisfying the circular polarization generating conditions. I have found however, that there are serious problems in the manufacture of these circular polarization patch antennas because the design of the antenna is complex, a factor that makes the manufacturing process unduly complicated.

Figure 2A:
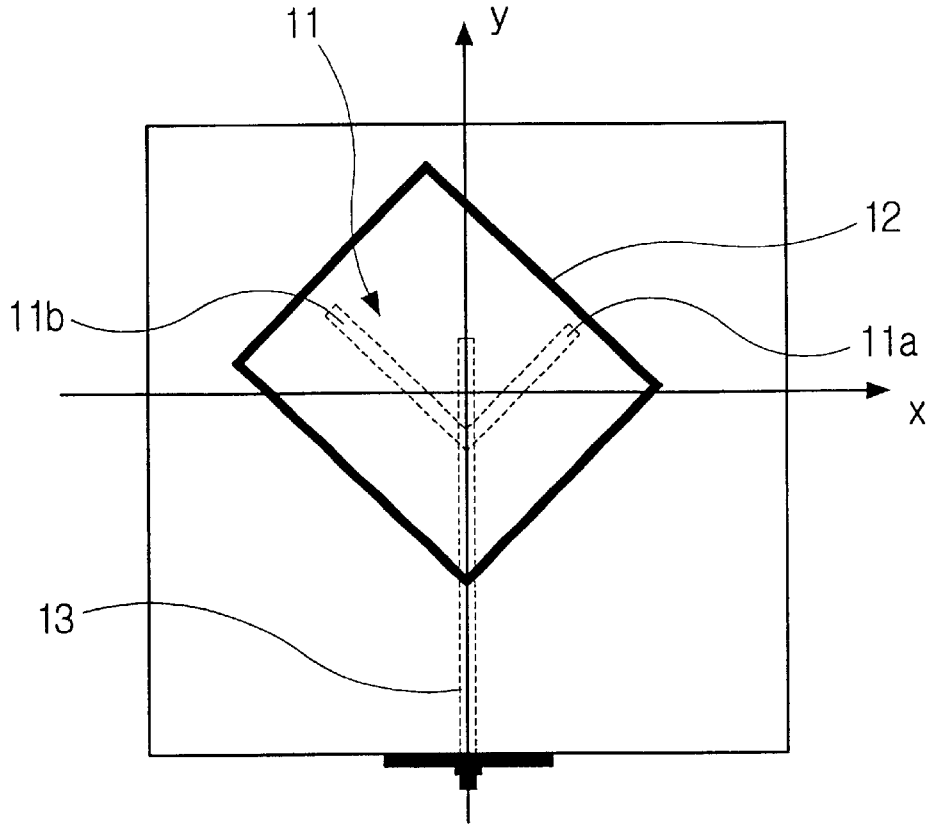
FIG. 2A is a plan view showing a structure of a V type circular polarization patch antenna using a microstrip line constructed according to the principles of the present invention.
Figure 2B:
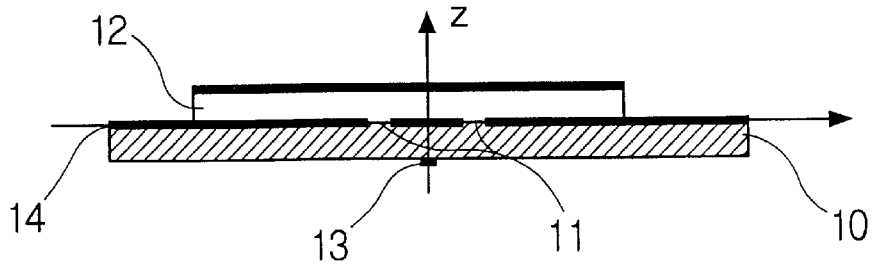
FIG. 2B is a side elevational view showing a structure of a V type circular polarization patch antenna using a microstrip line constructed according to the principles of the present invention.

Turning now to FIGS. 2A and 2B, reference will now be made in detail to particular embodiments of the present invention, examples of which are illustrated in the accompanying drawing. A V type circular polarization patch antenna 20 may be constructed according to the principles of the present invention by using an elongated strip or microstrip line 13 formed on one surface of a dielectric substrate 10. As shown in FIGS. 2A and 2B, there is provided a strip or microstrip line 13 on the rear face of dielectric substrate 10. A ground surface 14 forms a ground plane that extends over an entire front face of the dielectric substance 10. Dielectric substrate 10 and the overlying ground plane 14 may be coextensive in their adjoining surface areas, and may be rectangular in shape. A V shaped aperture 11 is formed with an orientation established on the basis of a center line "X" of the ground surface 14. Aperture 11 which is formed by partially removing the conducting material from both legs 11*a*, 11*b* of ground surface 14. Preferably, each leg 11*a*, 11*b* of the V shaped aperture 11 is at an angle of 45° with center line "X", and each leg 11*a*, 11*b* forms an angle of 90° with respect to each other. In addition, a patch 12 is mounted over an upper portion of the aperture 11 to completely cover aperture 11.

According to the principles of the present invention, when power is fed through the strip or microstrip line 13, an electromagnetic field that is excited within aperture 11 is further coupled to patch 12 which is mounted over the upper portion of aperture 11 and has a thickness of one half of the wavelength of the power that is fed via stripline 13, so that a radio wave is radiated according to the Fringe effect. Here, since the aperture 11 on the ground surface 14 is formed into the V shape and the patch 12, which is mounted over the upper portion of the aperture 11, is formed into a rectangular shape, the electromagnetic field coupled at a center portion of the aperture 11 is distributed to the right and left apertures 11*a*, 11*b* at an angle of 90° to each other. Therefore, the electromagnetic fields excited in the patch 12 are at right angles each other. Also, the lengths of a longer and shorter sides of patch 12 are properly adjusted so as to provide a phase difference of 90° according to their mutual impedance, thereby assuring generation of circular polarization.

Figure 3:
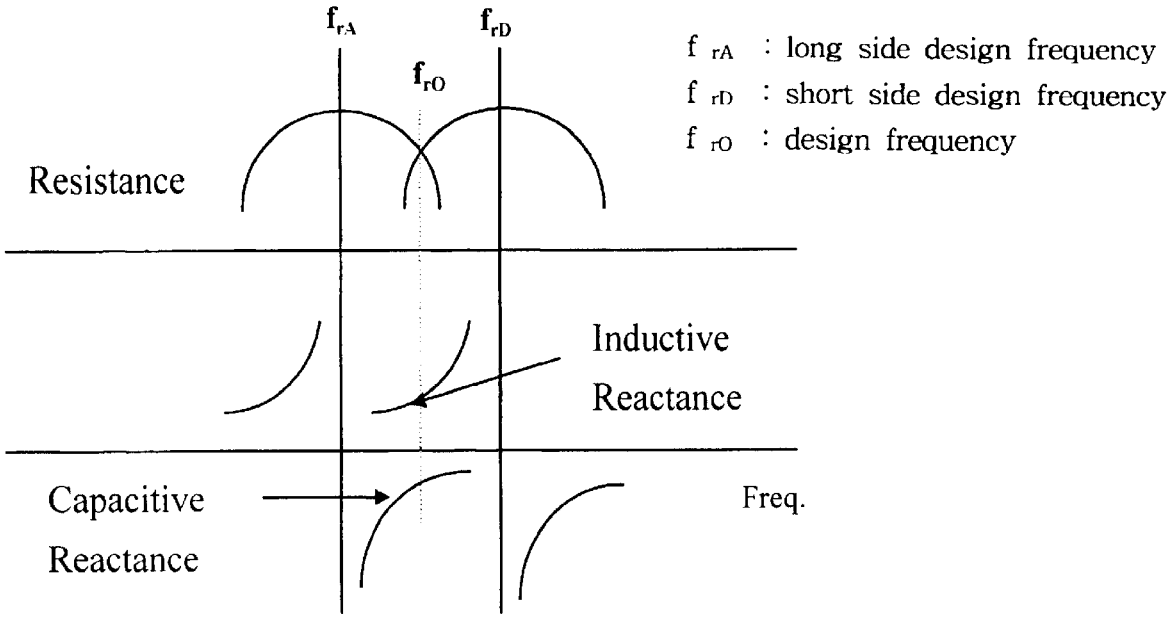
FIG. 3 is a graph illustrating a principle for generating circular polarization of an antenna during the practice of the present invention.

In other words, as shown in FIG. 3, a resonance frequency coupled from the shaped aperture 11 is $f_{rA}$ in the direction of the longer side direction of patch 12, and $f_{rD}$ in the direction of the shorter side of path 12. If the size of each aperture 11*a*, 11*b* is the same, the coupling coefficients between each aperture 11*a*, 11*b* will also be same. Current vectors corresponding to the two resonance frequencies have the same magnitude and are at right angles to each other.

Although apertures 11*a*, 11*b* are asymmetrical with respect to each other, the size and length of the apertures 11*a*, 11*b* may be adjusted so as to provide a phase difference of 90° caused by their mutual impedance. Therefore, the circular polarization generating conditions may be satisfied by adjustment of the sizes and.lengths of apertures 11*a*, 11*b*, and by adjustment between the lengths of and the longer and shorter sides of patch 12.

If four antennas constructed according to the principles of the present invention are arranged in an array with a regular square shape, the antenna is effectively enlarged into a circular polarization array antenna with a beam width of 38°. Moreover, if a phase transformation device, which can transform respectively phases of three antennas on the basis of one antenna, is provided on a feeding line, a circular polarization antenna may be created that is capable of electrical beam scanning so as to connect with a satellite which maintains a maximum receiving level among about three satellites that are always revolving on the same hemispherical side of the earth.

Figure 4A:
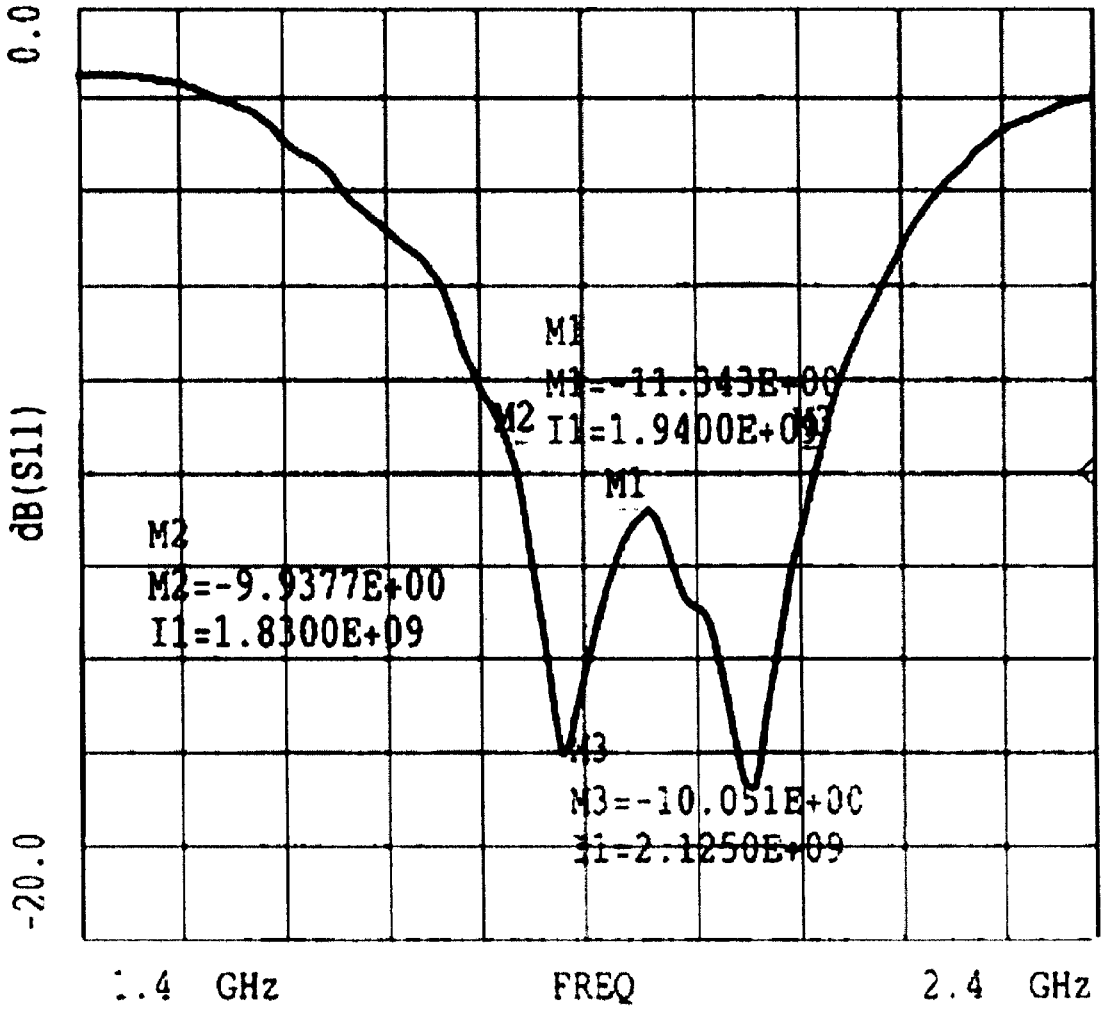
FIGS. 4A and 4B are graphs showing the features of impedance and reflection loss by an antenna during the practice of the present invention.
Figure 4B:
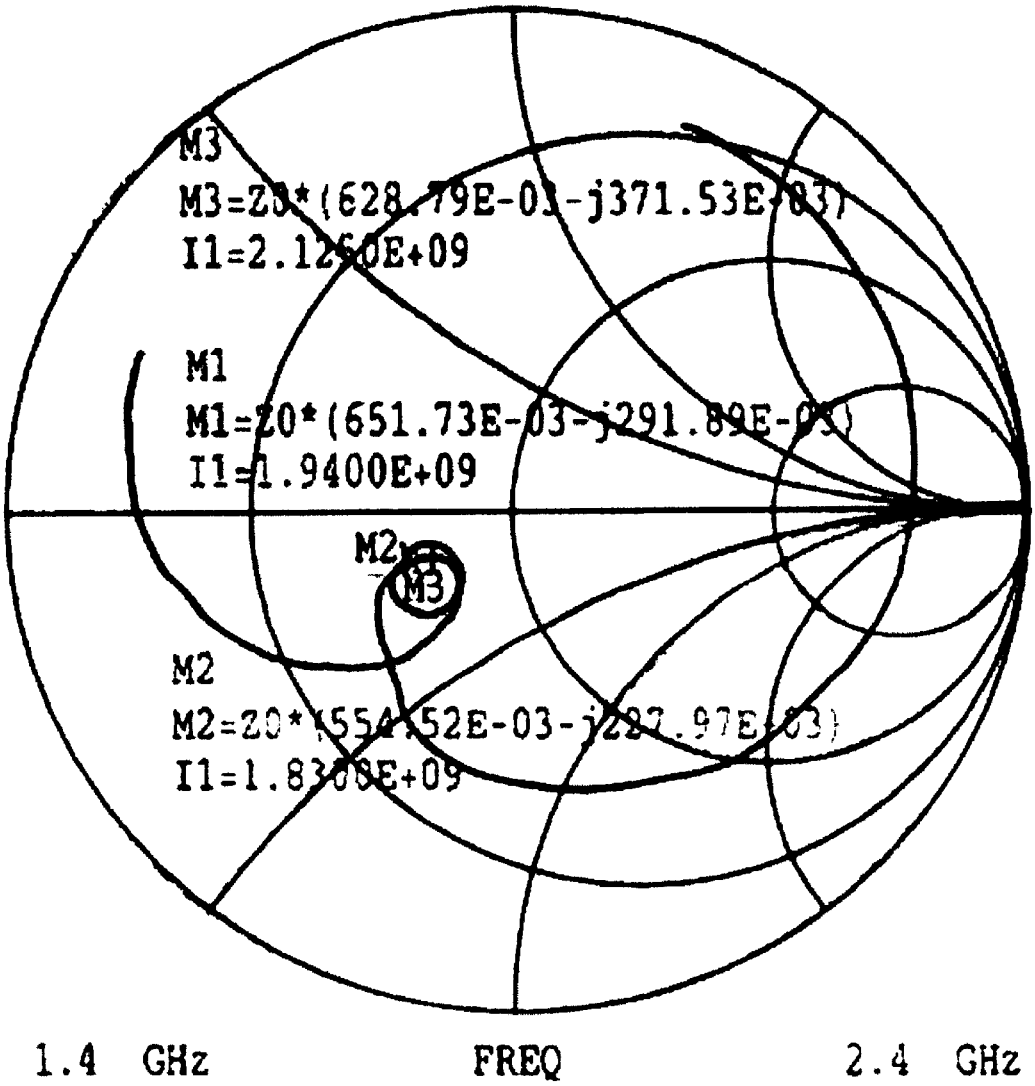

FIGS. 4A and 4B show an impedance feature and reflection loss for an antenna constructed according to the principles of the present invention. The design is set on the basis of 1.9375 GHz, which is one of center frequencies of IMT-2000. As a result, the reflection loss is −11.34 dB, the impedance feature is 32.6–j14.6 Ω, the band width for minus 10 dB is 15.2% (295 MHz), and the beam width is 60°. It is shown a comparative wide band by the two resonance frequencies.

Figure 5A:
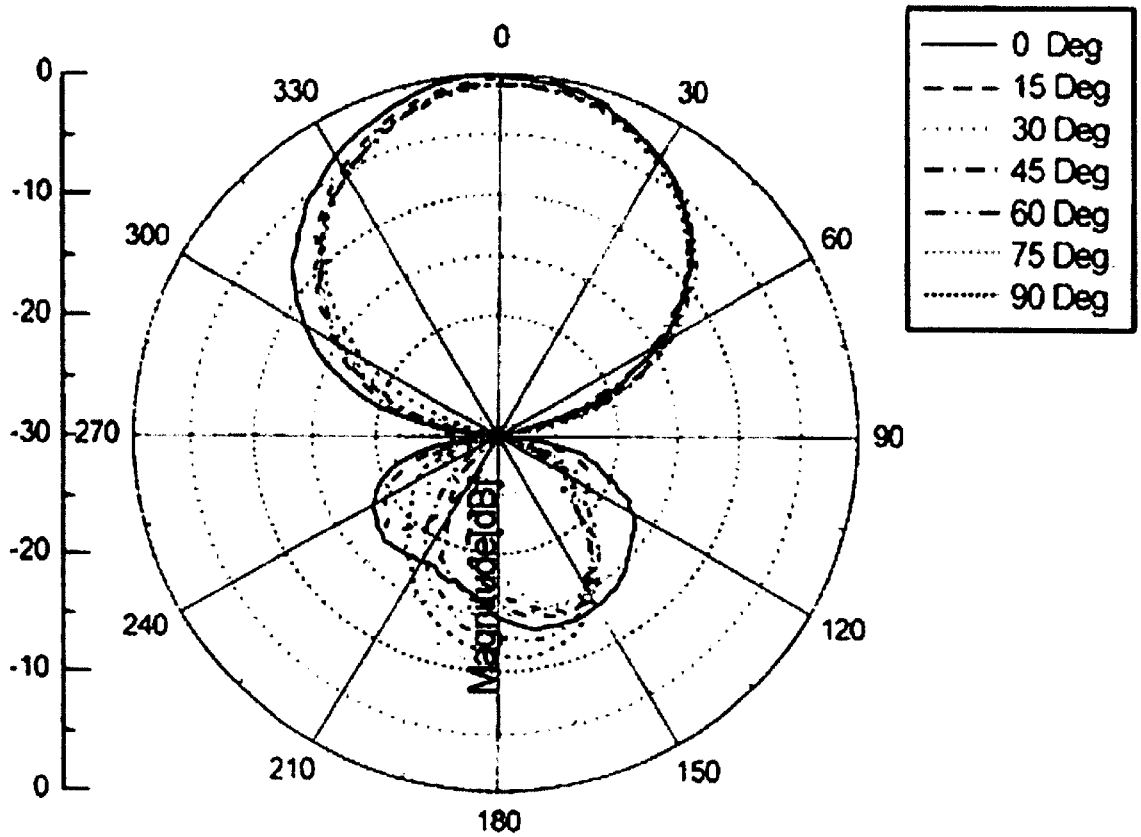
FIGS. 5A and 5B are graphs showing the features of axial ration and radiative pattern of an antenna during the practice of the present invention.
Figure 5B:
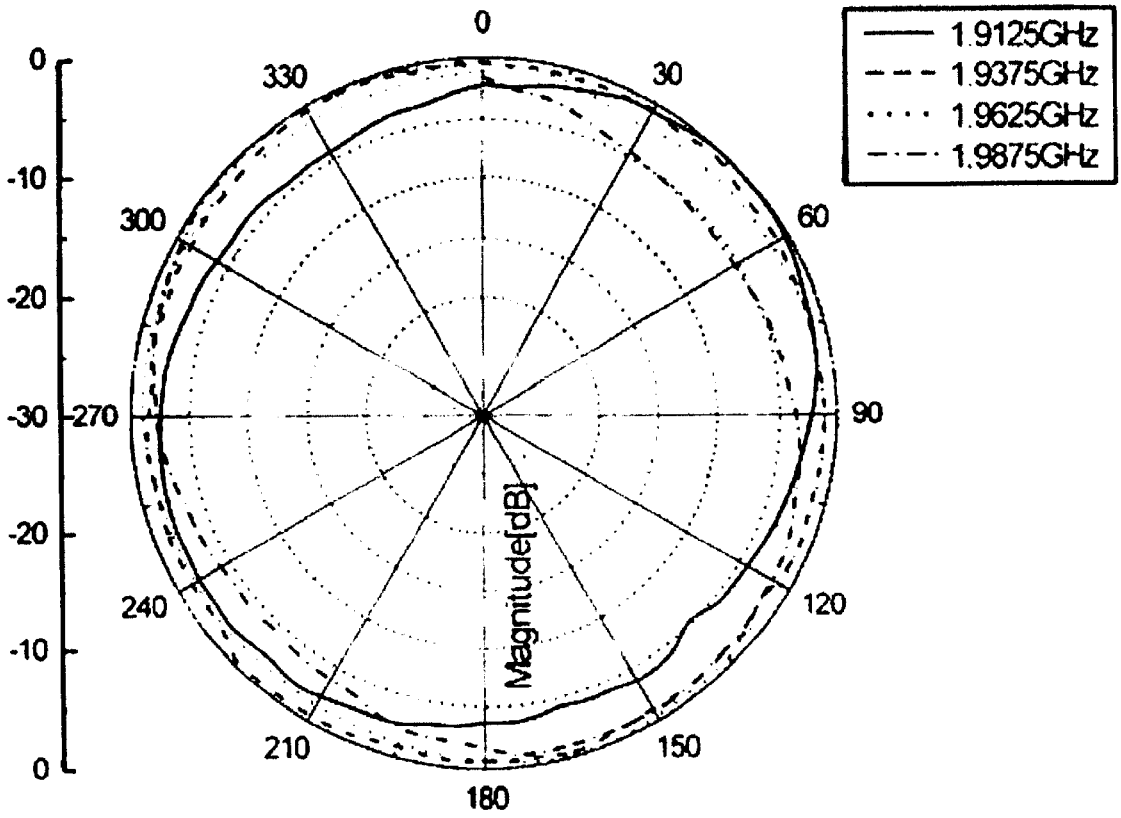

FIGS. 5A and 5B are graphs showing the features of an axial ratio and a radiative pattern of the antenna constructed according to the principles of the present invention. When the antenna is rotated by 15 degrees in the azimuthal direction, the radiative pattern is measured seven times. As the result, the beam width for −3 dB is about 60°. The posterior lobe pattern differs according to the rotational angle of the antenna, and maximally indicates up to −10 dB around 180°. The axial ratio is below 1.7 decibels at 1.9375 Ghz. A proper circular polarization is obtained with this embodiment.

Figure 6:
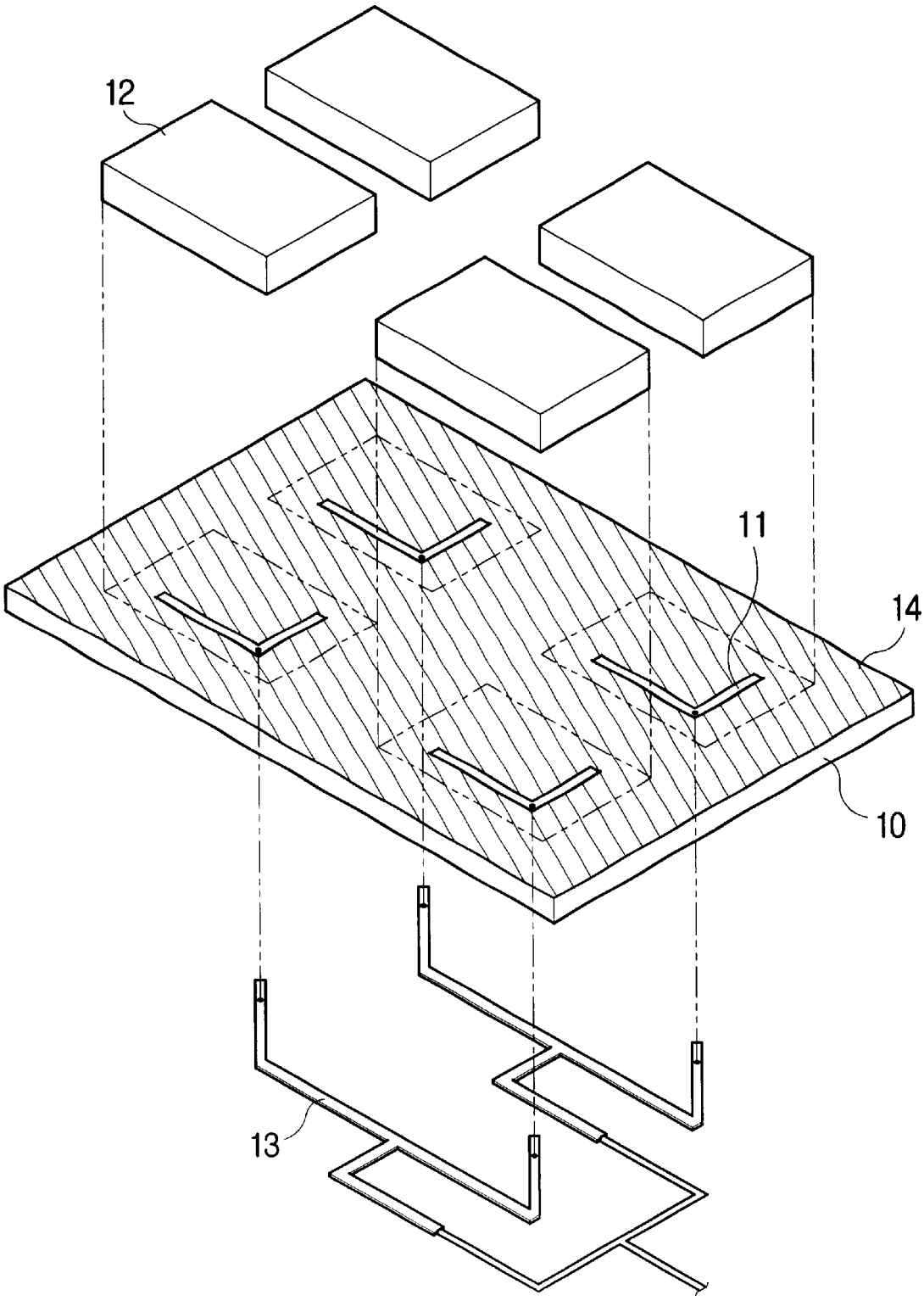
FIG. 6 is a perspective view illustrating an antenna system of the present application wherein four structures of a V type circular polarization patch antenna are arranged.

Referring to FIG. 6, FIG. 6 shows an antenna system wherein four structures of a V type circular polarization patch antenna according to the present invention are arranged in a square array to provide a circular polarization array antenna.

According to the V type aperture coupled circular polarization patch antenna, there are some advantages because the design for making the antenna is simplified and the manufacturing process is thereby facilitated, and the microstrip line and a patch are separated by a ground surface so that an active device may be mounted on the feed line in order to be capable of providing beam scanning for an antenna array.

It will be apparent to those skilled in the art that the details discussed in the foregoing paragraphs describe a circular polarization patch antenna that uses a microstrip line to enable satellite-based vehicle communication with a PCS base station and a satellite broadcasting receiver. The antenna has a thin planar structure that facilitates mass production, and is provided with a V-shaped aperture and a rectangular patch. Various modifications and variations of the present invention can be made without departing from the spirit or scope of the invention. Thus, it is intended that the present invention cover the modifications and variations of this invention provided they come within the scope of the appended claims and their equivalents.

What is claimed is:

1. A V type aperture coupled circular polarization patch antenna, comprising:

a microstrip line formed on a rear face of a dielectric substance;

a ground surface formed on an entire face of the dielectric substance;

a V type aperture formed at an angle established on a basis of a portion of the ground surface overlapping with the microstrip line; and a a patch formed into a rectangular shape and mounted at an upper portion of the aperture so as to cover the aperture.

2. The antenna of claim 1, wherein said angle is 90°.

3. A V type aperture coupled circular polarization patch antenna, comprising:

a microstrip line which is formed on a rear face of a dielectric substance;

a ground surface which is formed on an entire face of the dielectric substance;

a V type aperture which is formed at a desired angle on the basis of a portion of the ground surface, which overlaps with the microstrip line; and a patch formed into a rectangular shape, mounted at an upper portion of the aperture so as to cover the aperture, and having a long side and a short side, each length of the long and short sides of the patch being adjusted to provide a phase difference of 90° according to a mutual impedance.

4. A V type aperture coupled circular polarization patch antenna, comprising:

a microstrip line which is formed on a rear face of a dielectric substance;

a ground surface which is formed on an entire face of the dielectric substance;

a V type aperture which is formed at a desired angle on the basis of a portion of the ground surface, which overlaps with the microstrip line, and which has a size and a length adjusted so as to have a phase difference of 90° according to a mutual impedance; and a patch which is formed into a rectangular shape and is mounted at an upper portion of the aperture so as to cover the aperture.

5. In a mobile, aperture-coupled, circular-polarization antenna device adapted for reception of signals in satellite-based vehicle communication, said antenna device comprising:

a dielectric substrate having an upper planar surface and, parallel thereto and spaced therefrom, a lower planar surface;

a microstrip line disposed on the lower surface of the dielectric substrate;

a ground plane comprising a conductive coating covering the upper surface of the dielectric substrate;

an aperture formed in the ground plane: by removal therefrom of a predetermined portion of the conductive coating, said aperture having a predetermined size, shape, and orientation; and a patch mounted above the aperture and completely covering the aperture, said patch having a predetermined size, shape, and orientation, the improvement comprising: a means for maintaining a constant level of signal reception in the antenna device regardless of successive movements of the antenna device in different directions.

6. The antenna device of claim 5, wherein said means comprises configuration of the predetermined size, shape, and orientation of the aperture and configuration of the predetermined size, shape, and orientation of the patch in a manner such that a constant level of signal reception in the antenna device is maintained regardless of successive movements of the antenna device in different directions.

7. The antenna device of claim 5, wherein said aperture consists of a single chevron-shaped slot having a first slot segment longitudinally extending in a first direction, said first slot having an inner end at a central portion of the ground plane and an outer end distanced from the central portion of the ground plane; and having a second slot segment longitudinally extending in a second direction, said second slot having an inner end at the central portion of the ground plane and an outer end distanced from the central portion of the ground plane; said first and second slot segments joined at the inner ends thereof.

8. The antenna device of claim 7, wherein said first direction is orthogonal to said second direction.

9. The antenna device of claim 8, wherein said patch is rectangular and has a length oriented in the first direction and a width oriented in the second direction.

10. In a mobile, aperture-coupled, circular-polarization antenna device adapted for reception of signals in satellite-based vehicle communication, said antenna device comprising:

a dielectric substrate having an upper planar surface and, parallel thereto and spaced therefrom, a lower planar surface;

a microstrip line disposed on the lower surface of the dielectric substrate;

a ground plane comprising a conductive coating covering the upper surface of the dielectric substrate;

an aperture formed in the ground plane by removal therefrom of a predetermined portion of the conductive coating, said aperture having a predetermined size, shape, and orientation; and a rectangular patch mounted above the aperture and completely covering the aperture, said patch having a predetermined size, shape, and orientation;

the improvement comprising: a means for maintaining a constant level of signal reception in the antenna device regardless of successive movements of the antenna device in different directions, said means comprising configuration of the predetermined size, shape, and orientation of the aperture and configuration of the predetermined size, shape, and orientation of the rectangular patch in a manner such that a constant level of signal reception in the antenna device is maintained regardless of successive movements of the antenna device in different directions, said rectangular patch having a length oriented in a first direction and a width oriented in a second direction orthagonal to said first direction, said aperture consisting of a single chevron-shaped slot having:

a first slot segment longitudinally extending in said first direction, said first slot having an inner end at a central portion of the ground plane and an outer end distanced from the central portion of the ground plane;

a second slot segment longitudinally extending in said second direction, said second slot having an inner end at the central portion of the ground plane and an outer end distanced from the central portion of the ground plane;

said first and second slot segments joined at the inner ends thereof;

the first slot segment having a first slot length;

the second slot segment having a second slot length;

said first and second slot lengths adjusted to provide a phase difference of 90° according to mutual impedance; and the length and width of the patch adjusted to provide a phase difference of 90° according to mutual impedance.

11. The antenna device of claim 10, replicated four times, to provide a square array of four antenna devises, whereby a circular polarization array antenna system is provided.

12. The antenna device of claim 10, replicated four times to provide a square array of four antenna devices, and coupled to a phase transformation device for transforming respectively phases of three of the antenna devices on the basis of the fourth antenna device, whereby a circular polarization antenna system is provided which is adapted for electrical beam scanning and for connection to a satellite to maintain a maximum receiving level among a plurality of satellites always revolving on the same hemispherical side of the Earth.

13. In a method for manufacturing a mobile, aperture-coupled, circular-polarization antenna device adapted for reception of signals in satellite-based vehicle communication, said method comprising the steps of:

(1) providing a dielectric substrate having an upper planar surface and, parallel thereto and spaced therefrom, a lower planar surface, (2) disposing a microstrip line on the lower surface of the dielectric substrate;

(3) covering the upper surface of the dielectric substrate with a conductive coating to provide a ground plane;

(4) forming an aperture in the ground plane by removal therefrom of a predetermined portion of the conductive coating, said aperture having a predetermined size, shape, and orientation; and (5) mounting a patch above the aperture and completely covering the aperture, said patch having a predetermined size, shape, and orientation;

the improvement comprising configuring the predetermined size, shape, and orientation of the aperture, and configuring the predetermined size, shape, and orientation of the patch, in a manner such that a constant level of signal reception in the antenna device is maintained regardless of successive movements of the antenna device in different directions.

14. In a method for manufacturing a mobile, aperture-coupled, circular-polarization antenna device adapted for reception of signals in satellite-based vehicle communication, said method comprising the steps of:

(1) providing a dielectric substrate having an upper planar surge and, parallel thereto and spaced therefrom, a lower planar surface;

(2) disposing a microstrip line on the lower surface of the dielectric substrate;

(3) covering the upper surface of tie dielectric substrate with a conductive coating to provide a ground plane;

(4) forming an aperture in the ground plane by removal therefrom of a predetermined portion of the conductive coating, said aperture having a predetermined size, shape, and orientation; and (5) mounting a patch above the aperture and completely covering the aperture, said patch having a predetermined size, shape, and orientation;

the improvement comprising providing means, embodied in the respective predetermined sizes, shapes, and orientations of the aperture and patch, for maintaining a constant level of signal reception in the antenna device regardless of successive movements of the antenna in different directions.

15. The method of claim 14, wherein said aperture consists of a single chevron-shaped slot having a first slot segment longitudinally extending in a first direction, said first slot having an inner end at a central portion of the ground plane and an outer end distanced from the central portion of the ground plane; and having a second slot segment longitudinally extending in a second direction, said second slot having an inner end at the central portion of the ground plane and an outer end distanced from the central portion of the ground plane; said first and second slot segments joined at the inner ends thereof.

16. The method of claim 15, wherein said first direction is orthogonal to said second direction.

17. The method of claim 16, wherein said patch is rectangular and has a length oriented in the first direction and a width oriented in the second direction.

18. In a method for manufacturing a mobile, aperture-coupled, circularpolarization antenna device adapted for reception of signals in satellite-based vehicle communication, said method comprising the steps of:

(1) providing a dielectric substrate having an upper planar surface and, parallel thereto and spaced therefrom, a lower planar surface;

(2) disposing a microstrip line on the lower surface of the dielectric substrate;

(3) covering the upper surface of the dielectric substrate with a conductive coating to provide a ground plane;

(4) forming an aperture in the ground plane by removal therefrom of a predetermined portion of the conductive coating, said aperture having a predetermined size, shape, and orientation; and (5) mounting a rectangular patch above the aperture and completely covering the aperture, said patch having a predetermined size, shape, and orientation;

the improvement comprising providing means, embodied in the respective predetermined sizes, shapes, and orientations of the aperture and rectangular patch, for maintaining a constant level of signal reception in the antenna device regardless of successive movements of the antenna in different directions, said means comprising configuration of the predetermined size, shape, and orientation of the aperture and configuration of the predetermined size, shape, and orientation of the rectangular patch in a manner such that a constant level of signal reception in the antenna device is maintained regardless of successive movements of the antenna device in different directions, said rectangular patch having a length oriented in a first direction and a width oriented in a second direction orthogonal to said first direction, said aperture consisting of a single chevron-shaped slot having:

a first slot segment longitudinally extending in said first direction, said first slot having an inner end at a central portion of the ground plane and an outer end distanced from the central portion of the ground plane;

a second slot segment longitudinally extending in said second direction, said second slot having an inner end at the central portion of the ground plane and an outer end distanced from the central portion of the ground plane;

said first and second slot segments joined at the inner ends thereof;

the first slot segment having a first slot length;

the second slot segment having a second slot length;

said first and second slot lengths adjusted to provide a phase difference of 90° according to mutual impedance; and the length and width of the patch adjusted to provide a phase difference of 90° according to mutual impedance.

19. A method for maintaining constancy of signal reception level by a mobile antenna device, despite variations in motion of the antenna device, said method comprising the steps of:

(1) providing a dielectric substrate having an upper planar surface and, parallel thereto and spaced therefrom, a lower planar surface;

(2) disposing a microstrip line disposed on the lower surface of the dielectric substrate;

(3) covering the upper surface of the dielectric substrate with a conductive coating to provide a ground plane;

(4) forming an aperture in the ground plane by removal therefrom of a predetermined portion of the conductive coating, said aperture having a predetermined size, shape, and orientation; and (5) mounting a patch above the aperture and completely covering the aperture, said patch having a predetermined size, shape, and orientation;

wherein said aperture and said patch are sized, shaped, and oriented in a manner such that a constant level of signal reception in the antenna device is maintained regardless of successive movements of the antenna device in different directions.

20. A method for maintaining constancy of signal reception level by a mobile antenna device, despite variations in motion of the antenna device, said method comprising the steps of:

(1) providing a dielectric substrate having an upper planar surface and, parallel thereto and spaced therefrom, a lower planar surface;

(2) disposing a microstrip line disposed on the lower surface of the dielectric substrate;

(3) covering the upper surface of the dielectric substrate with a conductive coating to provide a ground plane;

(4) forming an aperture in the ground plane by removal therefrom of a predetermined portion of the conductive coating, said aperture having a predetermined size, shape, and orientation;

(5) mounting a patch above the aperture and completely covering the aperture, said patch having a predetermined size, shape, and orientation; and (6) providing the device with a means for maintaining a constant level of signal reception therein regardless of successive movements thereof in different directions.

21. The method of claim 20, wherein said aperture consists of a single chevron-shaped slot having a first slot segment longitudinally extending in a first direction, said first slot having an inner end at a central portion of the ground plane and an outer end distanced from the central portion of the ground plane; and having a second slot segment longitudinally extending in a second direction, said second slot having an inner end at the central portion of the ground plane and an outer end distanced from the central portion of the ground plane; said first and second slot segments joined at the inner ends thereof.

22. The method of claim 21, wherein said first direction is orthogonal to said second direction.

23. The method of claim 22, wherein said patch is rectangular and has a length oriented in the first direction and a width oriented in the second direction.

24. A method for maintaining constancy of signal reception level by a mobile antenna device, despite variations in motion of the antenna device, said method comprising the steps of:

(1) providing a dielectric substrate having an upper planar surface and, parallel thereto and spaced therefrom, a lower planar surface;

(2) disposing a microstrip line disposed on the lower surface of the dielectric substrate;

(3) covering the upper surface of the dielectric substrate with a conductive coating to provide a ground plane;

(4) forming an aperture in the ground plane by removal therefrom of a predetermined portion of the conductive coating, said aperture having a predetermined size, shape, and orientation;

(5) mounting a rectangular patch above the aperture and completely covering the aperture, said patch having a predetermined size, shape, and orientation; and (6) providing the device with a means for maintaining a constant level of signal reception therein regardless of successive movements thereof in different directions, said means comprising configuration of the predetermined size, shape, and orientation of the aperture and configuration of the predetermined size, shape, and orientation of the rectangular patch in a manner such that a constant level of signal reception in the antenna device is maintained regardless of successive movements of the antenna device in different directions, said rectangular patch having a length oriented in a first direction and a width oriented in a second direction orthogonal to said first direction, said aperture consisting of a single chevron-shaped slot having:

a first slot segment longitudinally-extending in said first direction, said first slot having an inner end at a central portion of the ground plane and an outer end distanced from the central portion of the ground plane;

a second slot segment longitudinally extending in said second direction, said second slot having an inner end at the central portion of the ground plane and an outer end distanced from the central portion of the ground plane;

said first and second slot segments joined at the inner ends thereof;

the first slot segment having a first slot length;

the second slot segment having a second slot length;

said first and second slot lengths adjusted to provide a phase difference of 90° according to mutual impedance; and the length and width of the patch adjusted to provide a phase difference of 90° according to mutual impedance.

25. A method for receiving communication signals at a substantially constant signal reception level, in a antenna system subject to being successively moved in different directions, said method comprising the steps of;

(1) receiving radiated communication signals via a vertical radiating antenna connected to a conductive plate;

(2) coupling the radiated communication signals through a device comprising:

a dielectric substrate having an upper planar surface and, parallel thereto and spaced therefrom, a lower planar surface;

a microstrip line disposed on the lower surface of the dielectric substrate;

a ground plane comprising a conductive coating covering the upper surface of the dielectric substrate;

an aperture formed in the ground plane by removal therefrom of a predetermined portion of the conductive coating, said aperture having a predetermined size, shape, and orientation;

a patch mounted above the aperture and completely covering the aperture, said patch having a predetermined size, shape, and orientation; and a means for maintaining a constant level of signal reception in the antenna regardless of successive movements of the antenna in different directions; and (3) coupling the signals from the microstrip to a transmission line connected to a communications receiver device.

26. The method of claim 25, wherein said aperture consists of a single chevron-shaped slot having a first slot segment longitudinally extending in a first direction, said first slot having an inner end at a central portion of the ground plane and an outer end distanced from the central portion of the ground plane; and having a second slot segment longitudinally extending in a second direction, said second slot having an inner end at the central portion of the ground plane and an outer end distanced from the central portion of the ground plane; said first and second slot segments joined at the inner ends thereof.

27. The method of claim 26, wherein said first direction is orthogonal to said second direction.

28. The method of claim 27, wherein said patch is rectangular and has a length oriented in the first direction and a width oriented in the second direction.

29. A method for receiving communication signals at a substantially constant signal reception level, in a antenna system subject to being successively moved in different directions, said method comprising the steps of:

(1) receiving radiated communication signals via a vertical radiating antenna connected to a conductive plate;

(2) coupling the radiated communication signals through a device comprising:

a dielectric substrate having an upper planar surface and, parallel thereto and spaced therefrom, a lower planar surface;

a microstrip line disposed on the lower surface of the dielectric substrate;

a ground plane comprising a conductive coating covering the upper surface of the dielectric substrate;

an aperture formed in the ground plane by removal therefrom of a predetermined portion of the conductive coating, said aperture having a predetermined size, shape, and orientation;

a rectangular patch mounted above the aperture and completely covering the aperture, said patch having a predetermined size, shape, and orientation; and a means for maintaining a constant level of signal reception in the antenna regardless of successive movements of the antenna in different directions, said means comprising configuration of the predetermined size, shape, and orientation of the aperture and configuration of the predetermined size, shape, and orientation of the rectangular patch in a manner such that a constant level of signal reception in the antenna device is maintained regardless of successive movements of the antenna device in different directions, said rectangular patch having a length oriented in a first direction and a width oriented in a second direction orthagonal to said first direction, said aperture consisting of a single chevron-shaped slot having:

a first slot segment longitudinally extending in said first direction, said first slot having an inner end at a central portion of the ground plane and an outer end distanced from the central portion of the ground plane;

a second slot segment longitudinally extending in said second direction, said second slot having an inner end at the central portion of the ground plane and an outer end distanced from the central portion of the ground plane;

said first and second slot segments joined at the inner ends thereof;

the first slot segment having a first slot length;

the second slot segment having a second slot length;

said first and second slot lengths adjusted to provide a phase difference of 90° according to mutual impedance; and the length and width of the patch adjusted to provide a phase difference of 90° according to mutual impedance; and (3) coupling the signals from the microstrip to a transmission line connected to a communications receiver device.

30. A method of electrical beam scanning to maintain a maximum receiving level among a plurality of satellites always revolving on the same hemispherical side of the Earth, said method comprising the steps of:

(1) providing four antenna devices, each of said devices comprising:

a dielectric substrate having an upper planar surface and, parallel thereto and spaced therefrom, a lower planar surface;

a microstrip line disposed on the lower surface of the dielectric substrate;

a ground plane comprising a conductive coating covering the upper surface of the dielectric substrate;

an aperture formed in the ground plane by removal therefrom of a predetermined portion of the conductive coating, said aperture having a predetermined size, shape, and orientation; and a patch mounted above the aperture and completely covering the aperture, said patch having a predetermined size, shape, and orientation, the respective predetermined sizes, shapes, and orientations of said aperture and patch configured in a manner such that a constant level of signal reception in the antenna device is maintained regardless of successive movements of the antenna device in different directions;

(2) arranging the four antenna devices in a square array;

(3) coupling the antenna devices to a phase transformation device for transforming respectively phases of three of the antenna devices on the basis of the fourth antenna device; and (4) pointing the array at a one of the satellites.

* * * * *